US007582204B2

(12) United States Patent
Gueret et al.

(10) Patent No.: US 7,582,204 B2
(45) Date of Patent: Sep. 1, 2009

(54) METHOD FOR TREATING A HYDROCARBON FEEDSTOCK INCLUDING RESIN REMOVAL

(75) Inventors: Christophe Gueret, St Romain en Gal (FR); Raphaël Huyghe, Lyons (FR); Hugues Dulot, Lyons (FR); Patrick Euzen, Paris (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 355 days.

(21) Appl. No.: 10/584,048

(22) PCT Filed: Dec. 13, 2004

(86) PCT No.: PCT/FR2004/003210

§ 371 (c)(1),
(2), (4) Date: Jun. 22, 2006

(87) PCT Pub. No.: WO2005/071047

PCT Pub. Date: Aug. 4, 2005

(65) Prior Publication Data

US 2007/0108102 A1 May 17, 2007

(30) Foreign Application Priority Data

Dec. 23, 2003 (FR) ..... 03 15212

(51) Int. Cl.
*C10G 7/00* (2006.01)
*C10G 21/00* (2006.01)
*B01D 3/00* (2006.01)

(52) U.S. Cl. ..... 208/347; 208/87; 208/92; 208/308; 208/311; 208/312; 208/313; 208/320; 208/322; 208/337

(58) Field of Classification Search ..... 208/308, 208/311, 312, 313, 320, 322, 337, 347, 87, 208/92
See application file for complete search history.

(56) References Cited

U.S. PATENT DOCUMENTS 2,109,895 A * 3/1938 Anderson ..... 208/299
2,361,080 A * 10/1944 Bolt et al. ..... 208/15
2,914,457 A 11/1959 Beavon
3,256,175 A * 6/1966 Kozlowski et al. ..... 208/58
3,617,475 A * 11/1971 Offutt et al. ..... 208/33

(Continued)

FOREIGN PATENT DOCUMENTS

EP 0697455 A 2/1996

*Primary Examiner*—Walter D Griffin
*Assistant Examiner*—Huy-Tram Nguyen
(74) *Attorney, Agent, or Firm*—Millen, White, Zelano & Branigan, P.C.

(57) ABSTRACT

The invention relates to a process, including removal of resins, for the treatment of a hydrocarbon charge, at least 80% of the compounds of which have a boiling point which is above or equal to 340° C., in which process:

the charge is sent to a fractionation stage during which the recovery takes place of at least one heavy fraction and at least one light fraction, at least some of the heavy fraction is sent to an extraction stage during which resins contained in said heavy fraction are extracted, and a purified fraction is recovered, a mixture is made which comprises at least part of the purified fraction which was obtained in the extraction stage and at least one light fraction which was obtained in the fractionation stage, and the mixture thus obtained is sent to a cracking stage.

18 Claims, 1 Drawing Sheet

U.S. PATENT DOCUMENTS 3,622,496 A * 11/1971 Biribauer et al. ..... 208/35
3,660,273 A * 5/1972 Cummins ..... 208/96
4,039,429 A * 8/1977 VAN Klinken et al. ..... 208/50
4,213,847 A * 7/1980 Chen et al. ..... 208/111.15
4,381,234 A * 4/1983 Audeh et al. ..... 208/327
4,454,023 A 6/1984 Lutz
4,460,454 A * 7/1984 Iijima et al. ..... 208/40
4,640,762 A * 2/1987 Woods et al. ..... 208/56
4,750,357 A * 6/1988 Anderson et al. ..... 73/195
5,286,369 A * 2/1994 Roberie et al. ..... 208/114
6,099,719 A * 8/2000 Cody et al. ..... 208/87
6,325,918 B1 * 12/2001 Cody et al. ..... 208/87
6,592,748 B2 * 7/2003 Cody et al. ..... 208/87
6,726,835 B2 * 4/2004 Towler et al. ..... 208/211
6,974,535 B2 * 12/2005 Cody et al. ..... 208/57
2002/0040863 A1 * 4/2002 Cody et al. ..... 208/18
2002/0153281 A1 * 10/2002 Cody et al. ..... 208/87
2003/0116474 A1 * 6/2003 Towler et al. ..... 208/237

* cited by examiner

METHOD FOR TREATING A HYDROCARBON FEEDSTOCK INCLUDING RESIN REMOVAL

This application is a National Stage application of co-pending PCT application PCT/FR2004/003390 filed Dec. 27, 2004, which was published in French under PCT Article 21(2) on Jul. 28, 2005, and which claims priority from French patent application so. 03/15,467 filed Dec. 26, 2003. These applications are incorporated herein by reference in their entireties.

The present invention relates to the technical domain of hydrocarbon charge cracking. In particular, the invention is concerned with a process in which the resins of a charge comprising hydrocarbons are removed prior to the cracking of said charge.

International Patent Application WO 99/67345 describes a method of producing cleaner fuels, in which natural polar compounds are removed beforehand from a petroleum hydrocarbon fraction with a boiling point of between 110 and 560° C., making it possible to improve the efficiency of catalytic treatments directed at the production of said fuels. That patent application more particularly describes the fact that this removal of the natural polar compounds takes place by adsorption/desorption or by solvent extraction.

In this type of method, the removal of pollutants is usually carried out on all of the hydrocarbon charge which has to undergo a catalytic treatment. This means that the equipment for extracting the pollutants has to be dimensioned suitably in accordance with the flow of the charge. Furthermore, the extraction equipment used has to be dimensioned in accordance with the concentration and nature of the pollutants.

American Patent U.S. Pat. No. 4,454,023 describes a process for improving the fluidity of a heavy and viscous hydrocarbon, including viscoreduction, distillation and solvent extraction. That patent does not refer to any cracking stage. Moreover, the fraction sent to the solvent extraction stage is the heaviest distillation fraction.

It has been found that the use of an extraction stage in which resins are selectively extracted, and this on a specific fraction of a charge which comprises a vacuum distillate, results in a significant reduction in the investment costs and operating cost of the process for removal of resins and for the cracking of said charge, whilst a good performance level can be maintained for the cracking of said charge. That level of performance of the cracking operation can be appreciated by the extended cycle duration of the catalyst used and by the operating conditions which are more economical, e.g. a reduction in pressure.

The present invention therefore relates to a process for the treatment of a hydrocarbon charge, at least 80% of the compounds of which have a boiling point which is above or equal to 340° C., in which process:

a) the charge is sent to a fractionation stage during which the recovery takes place of:

at least one heavy fraction comprising at least 90% by weight of compounds which boil at above 450° C. and at below 700° C., and at least one light fraction which boils at less than the heavy fraction(s), a residuum which boils at more than the heavy fraction(s), b) at least part of the heavy fraction is sent to an extraction stage during which at least some of the resins contained in said heavy fraction are extracted, and a purified fraction is recovered, c) a mixture is made which comprises at least part of the purified fraction which was obtained in the extraction stage and at least one light fraction which was obtained in the fractionation stage, and d) the mixture thus obtained is sent to a cracking stage.

The hydrocarbon charge of the invention is such that at least 80% of the compounds have a boiling point which is above or equal to 340° C., preferably above 350° C.

The hydrocarbon charge usually contains more than 30% by weight, preferably more than 50% by weight, of compounds which boil at between 340° C. and 700° C.

The hydrocarbon charge can be a residuum which originates from direct distillation (atmospheric), or from a conversion process such as coking, from a fixed bed hydroconversion process like the HYVAHL process, or from a process in boiling bed like the H-Oil process. The hydrocarbon charge can be formed by mixing the afore-mentioned charges in any random proportion.

The invention proves to be particularly worthwhile for hydrocarbon charges which are rich in impurities like nitrogen, polyaromatics or which have a Conradson Carbon residuum or a high asphalt content. This is so with heavy crude residuum or West African residuum, for example.

According to one feature of the invention, an extraction stage is carried out on at least part of a heavy fraction of the hydrocarbon charge. All of the heavy fractions are usually obtained with a yield of at least 15% by weight in relation to the 340-700° C. fraction of the hydrocarbon charge.

Preferably, the heavy fraction is obtained with a yield of at least 20% by weight, or even of at least 30% by weight, in relation to the vacuum distillate.

The heavy fraction can comprise at least 90% by weight of compounds which boil at less than 700° C. and at above 480° C., or even at above 500° C.

In parallel to this heavy fraction, during the fractionation stage, at least. one light fraction is obtained, which, contrary to said heavy fraction, is not subjected to an extraction operation. At least one light fraction is obtained with a yield of at least 5% by weight in relation to the 340-700° C. fraction of the charge, preferably at least 20% or at least 50%.

Preferably, this light fraction comprises at least 90% by weight of compounds which boil at less than 450° C., preferably at less than 480° C., and more preferably at less than 500° C.

Preferably, one single heavy fraction is obtained, and preferably all of that fraction is treated in the extraction stage.

According to another feature of the invention, the extraction stage is carried out for the selective extraction of resins.

These resins are usually present in the 340° C.-700° C. fraction of the hydrocarbon charge used in the process of the invention.

The content of resins in the 340° C.-700° C. fraction of the charge can vary from 3 to 15% by weight.

The heavy fraction resulting from the first fractionation stage can, for its part, comprise a resin content which is greater than 5% by weight, or even greater than 10% by weight, or even greater than 15% by weight.

Within the domain of petroleum, the term, "resin" usually denotes constituents which have been eluted from solid adsorbents by means of polar solvents. Thus, the resins are usually characterised by their polarity rather than by their chemical nature; hence, the use of separation methods for the purpose of isolating them.

These separation methods (such as ASTM-D-4124) which enable resins to be isolated can be liquid chromatography methods on petroleum cuts of the vacuum distillate type, or of the residuum type, in which:

firstly, a mixture of these cuts is mixed with a solvent such as n-heptane in order to precipitate asphaltenes and recover a soluble portion comprising maltenes, and secondly, the resins are isolated by eluting said soluble portion in a chromatography column which contains, for example, activated alumina and silica gel with the aid of a very polar solvent, such as a mixture of methylene chloride, toluene and methanol.

The resins which are isolated by these characterisation methods are mainly constituted by a mixture comprising condensed naphteno-aromatic compounds, and by sulphur-, nitrogen-, oxygen-containing compounds, and, possibly, by compounds which contain metals like nickel and vanadium.

It has been noted that an extraction step whose objective is the selective extraction of resins makes it possible to improve the activity and/or selectivity of the catalysts employed in the subsequent stages of the process of the invention. Thus, the selective extraction of the resins defined hereinabove permits a special improvement in the performance of the subsequent cracking stage in the process of the invention.

During the extraction stage, at least 10% by weight of the resins contained in said heavy fraction is extracted from the heavy fraction (quantitative determination by a separation method of the ASTM-D-4124 type).

Preferably, at least 20% by weight, preferably at least 40% by weight, or even at least 50% by weight, of the resins contained in the heavy fraction is extracted.

The resins which are extracted from the heavy fraction are usually polar compounds. The polarity of these resins can be determined from the relationship existing between said polarity, on the one hand, and between the naphteno-aromatic structure and nitrogen content of those resins, on the other hand. In fact, at least 90% by weight, or even at least 95% by weight, of the nitrogen of a vacuum distillate is usually contained in the resins of said vacuum distillate.

The naphteno-aromatic structure can be determined by nuclear magnetic resonance (NMR of $C^{13}$ and $^{1}H$, cf. ASTM D5292). The nitrogen content, for its part, can be measured by chemiluminescence (cf. ASTM D4629).

Nuclear magnetic resonance analysis (NMR of $C^{13}$) reveals that the average structure of the resins in the heavy fraction can be characterised by:

a proportion of aromatic carbon (AC) of more than 50% by weight, or even of more than 60% by weight, a proportion of quaternary aromatic carbon of more than 30% by weight, or even of more than 35% by weight, a rate of condensed quaternary aromatic carbon of more than 10% by weight, or even of more than 15% by weight, and a condensation index of more than 2.3, or even of more than 2.6.

NMR analysis of the $C_{13}$ of the resins of the 340° C.-700° C. fraction of the charge reveals that the average structure of those resins can be characterised by:

a rate of aromatic carbon (AC) of less than 50% by weight, a rate of quaternary aromatic carbon of less than 30% by weight, a rate of condensed quaternary aromatic carbon of less than 10% by weight, and a condensation index of less than 2.3.

Chemiluminescence analysis of the nitrogen content reveals that the nitrogen content of the resins of the heavy fraction can be 1.5 times greater than, or even twice as great as, or even 2.5 times greater than that of the resins of the charge.

The polarity of the resins of that heavy fraction of the vacuum distillate is thus generally greater than that of the resins of the charge.

Extraction of the resins from the heavy fraction can usually enable a purified fraction to be obtained with a content of polyaromatic compounds comprising up to 5 cycles of less than 2% by weight, preferably of less than 1% by weight. That content of polyaromatics comprising up to 5 cycles of the purified fraction can be measured by Fischer's mass spectrometry (cf. Fischer I. P., Fischer P., Talanta, 21, 867-875 (1974) and Bouquet M., Brument J., Fuel Science and Technology INTL, 8(9), 961-986 (1990).

The extraction of resins from the heavy fraction can also make it possible to obtain a purified fraction, the nitrogen content of which is reduced by at least 20%, preferably by 30% by weight, more preferably by 40% by weight in relation to the heavy fraction introduced in the extraction stage. This nitrogen content of the purified fraction can be measured by chemiluminescence (cf. ASTM D4629).

The extraction stage can be carried out by any means known to the skilled person. In particular, the extraction stage can be carried out by adsorption/desorption, or, preferably, by solvent extraction.

In the preferred case where the extraction stage is carried out by solvent extraction, this extraction stage usually comprises contacting the heavy fraction with a solvent based on light hydrocarbons. This contacting can be carried out in an extraction zone or by simple mixing. The quantity of solvent, temperature and pressure are selected in such a way as to permit the formation of two separate phases constituted, firstly, by a liquid mixture comprising mainly solvent and deresined oil, and, secondly, by a fluid mixture comprising mainly solvent and oil with resin. The phases which are thus formed can then be separated from one another, e.g. by decanting. The solvent of each phase can finally be eliminated by vaporisation for recycling.

This extraction stage therefore makes it possible for a large part of the compounds with resin of the charge being treated to be extracted, said compounds usually having naphteno-aromatic structures.

The solvent which is used during the extraction stage is preferably a paraffinic solvent. That solvent can comprise mainly (or be constituted by) compounds with 3 to 7 carbon atoms, preferably with 3 to 5 carbon atoms.

The yield of oil extracted and the quality of the oil depend upon the nature of the solvent used. The yield of deresined oil usually increases with the carbon number of the solvent, to the detriment of the quality of the oil extracted.

The extraction stage is usually carried out in a mixer settler, or, preferably, in an extraction column.

The operating conditions of the extraction stage can be comparable to those of a de-asphalting process. The volume ratio between the light hydrocarbon-based solvent to the heavy fraction to be extracted is usually between 2 and 12, preferably between 3 and 5.

By way of example, during the extraction stage, a preformed mixture comprising the heavy fraction and a first fraction of solvent is introduced into an extraction column in order to carry out the precipitation of a phase with resin by decanting at the bottom of the column. A second solvent fraction is introduced into the decanting zone. Decanting of the part with resin then takes place by washing with the pure solvent, counter-current with the emulsion of the fraction with resin in a mixture comprising mainly solvent and oil. It is promoted by an increase in the proportion of solvent, i.e. the environment comprising the solvent and oil is replaced by an environment comprising pure solvent, this being done at a low temperature.

Moreover, the existence of a temperature gradient between the top and bottom of the extraction column usually makes it possible to create an internal reflux which has the effect of improving the separation between the oily medium and the resins. In fact, the mixture which comprises mainly solvent and oil which is heated at the top of the extraction column makes it possible to precipitate a fraction with resin which descends into the extraction column. The ascending counter-current of this mixture therefore tends to dissolve, at lower temperature, the lightest fractions with resin. The temperature depends on the nature of the solvent used and is usually between 70 and 220° C.

If solvent extraction takes place in an extraction column using propane as the solvent, the following operating conditions are advantageous for the extraction operation:

- a solvent ratio of between 2/1 and 12/1, preferably of between 4/1 and 10/1,
- a temperature at the head of the extractor of between 55 and 95° C.,
- a temperature at the bottom of the extractor of between 30 and 80° C.,
- a pressure in the extractor of between 300 and 400 MPa, to be adjusted so that all the products remain in the liquid state, and
- between 2 and 5 calculated stages.

According to another feature of the process of the invention, the cracking stage is carried out on a mixture comprising the purified fraction obtained during the extraction stage with at least one light fraction obtained during the fractionation stage.

Preferably, during the mixing stage of the process of the invention, a mixture is made which further comprises other fractions which can be obtained during the fractionation stage, or even all of those other fractions.

It has been noted that carrying out the hydrocarbon cracking stage on a mixture, wherein, firstly only a well-defined fraction of said mixture has been subjected to an extraction stage beforehand, and, secondly, wherein the extraction of said fraction has the objective of extracting well specified compounds, namely resins in this instance, is in no way detrimental to the performance of said cracking operation, and, on the contrary, makes it possible to work at much lower temperatures during the cracking operation.

Indeed, it has been noted that extracting the resins from all of the charge, except for the residuum (i.e. from all of the heavy and light fractions) produces an effluent which shows itself to be more heat-proof during cracking than the effluent according to the invention, for an equivalent content of resin in the 340° C.-700° C. fraction of the charge.

As well as this technical advantage, the equipment needed for the resin extraction stage is of reduced size.

The cracking stage of the process of the invention can comprise catalytic cracking and/or hydrocracking.

The specific conditions of the extraction stage of the process of the invention are such that the mixture on entry to the cracking stage has a high level of purity which permits high-performance catalytic cracking.

If the cracking stage comprises catalytic cracking, at least some of the mixture is cracked by catalytic cracking in order to obtain an effluent comprising petrol, gas oil and a residuum. This catalytic cracking can be cracking in a fluidised bed, known as "fluid catalytic cracking" or FCC.

In the event of FCC cracking, the process of the invention makes it possible to obtain at the entry to the cracking stage an effluent with a reduced Condradson Carbon residuum and nitrogen content which is favourable for obtaining a high conversion of the mixture together with high yields of petrol and gas oil.

In the case of catalytic cracking, at least some of the mixture can be cracked catalytically under conditions well-known to the skilled person for the production of a fuel fraction, which itself can comprise a petrol fraction and a gas oil fraction, as well as a "slurry" fraction. The fuel fraction is usually sent, at least in part, to the fuel pools. The "slurry" fraction, for its part, can be sent at least in part to the heavy fuel pool, or recycled, at least in part, at the entry to the catalytic cracking stage.

Within the scope of the present invention the term, "conventional catalytic cracking" encompasses the cracking processes which comprise at least one regeneration stage by partial combustion and those comprising at least one regeneration stage by total combustion and/or those comprising at least one partial combustion stage as well as at least one total combustion stage.

A general description of catalytic cracking is given in Ullmans Encyclopedia of Industrial Chemistry Volume A 18, 1991, pages 61 to 64.

The catalytic cracking stage can be preceded advantageously by a hydrotreatment. In order to purify the mixture of impurities, such as the sulphur and nitrogen which may not have been completely removed during the extraction stage, pre-treatment of the mixture by way of a catalytic process in the presence of hydrogen can be necessary in order to protect the cracking catalysts or improve the quality of the cracking products, for example. This stage can be carried out, for example, using a NiMo type catalyst on alumina under conditions well-known to the skilled person.

Preferably, the cracking stage is hydrocracking.

In this hydrocracking stage, at least part of the mixture is cracked on catalyst in the presence of hydrogen, under conditions well-known to the skilled person, in order to produce at least one fuel fraction (petrol fraction, kerosene fraction, gas oil fraction) following distillation. At least some of this/these fuel fraction(s) is usually sent to the gasoline pools.

In the case of hydrocracking, the residuum fraction obtained can be treated in various ways. In one embodiment, this residuum fraction can be sent, at least in part, to a dewaxing and hydro-finishing section in order to produce oil bases. In another embodiment with a fuel objective, this residuum fraction can be recycled, at least in part, at the entry to the hydrocracking stage. In yet another embodiment, this residuum fraction can be sent, at least in part, to an FCC unit.

The operating conditions used according to this embodiment make it possible to obtain a crack per pass of products with boiling points of less than 340° C., even of less than 370° C., of more than 10% by weight, preferably of between 15 and 95% by weight.

The hydrocracking can be carried out at a temperature which varies from 340 to 450° C., preferably which varies from 340 to 420° C. The pressure, for its part, can be significantly reduced in comparison with hydrocracking stages for prior art vacuum distillates which usually require a high partial pressure of hydrogen.

The hydrocracking pressure can advantageously vary from 4 to 20 MPa, preferably from 4 to 16 MPa. Low or moderate pressures (4 to 10 MPa) can be distinguished from higher pressures (more than 10 MPa to 16MPa).

The term, "hydrocracking" encompasses mild hydrocracking in which the objective is a pre-treatment to convert a charge resulting from FCC, hydrorefining in which the objective is to produce a residuum for making lubricating oils and middle distillates, and conventional hydrocracking, the flexibility of which makes it possible to produce either middle distillates, or, conjointly, middle distillates and a residuum for making lubricating oils.

One advantage of the process of the invention is that it reduces the loss of activity of the catalyst(s) used during the cracking stage and/or the catalytic pre-treatment stage by reducing the impurities which tend to become highly adsorbed on the catalyst, which reduce its cracking acid function and/or which are coke precursors. In the case of a catalytic cracking stage, this is manifested by reduced consumption of fresh catalyst for a given conversion level, and, in the case of a hydrocracking stage, by a cycle of longer duration.

Another advantage of the process of the invention is that if the cracking stage comprises (or is) hydrocracking, it permits a significant reduction to the pressure at which the hydrocracking state is carried out. Selective extraction of resins actually permits the removal of the unsaturated compounds which usually consume a significant quantity of hydrocracking hydrogen. Use of the process of the invention thus permits a reduction in the operating costs of the hydrocracking apparatus.

Another advantage of the invention is that the negative effects of the resins and nitrogen are limited, particularly on the cracking catalyst.

Another advantage of the invention is that it limits the negative effects of polyaromatics on the stability of the catalysts and on the quality of the products.

Another advantage of the process of the invention is that if the cracking stage comprises (or is) hydrocracking, the equipment used during the hydrocracking operation is reduced in size. Another advantage of the process of the invention is that it permits a reduction in the size of the equipment used during the extraction stage, since the extraction operation is only carried out on a heavy fraction of the vacuum distillate.

BRIEF DESCRIPTION OF DRAWING

For a better understanding, a preferred embodiment of the process of the invention is illustrated in FIG. 1. This embodiment is given by way of example and is in no way limitative in character. This illustration of the process of the invention does not comprise all of the components needed for its implementation. Only the elements needed to understand the invention have been shown there, the skilled person being capable of completing the drawing in order to carry out the invention.

The hydrocarbon charge is sent via the conduit 1 to a vacuum distillation column 2. From that distillation column, a light fraction is drawn off via the conduit 3, a heavy fraction is drawn off via the conduit 4, and a vacuum residuum is drawn off via the conduit 5.

Figure 1:
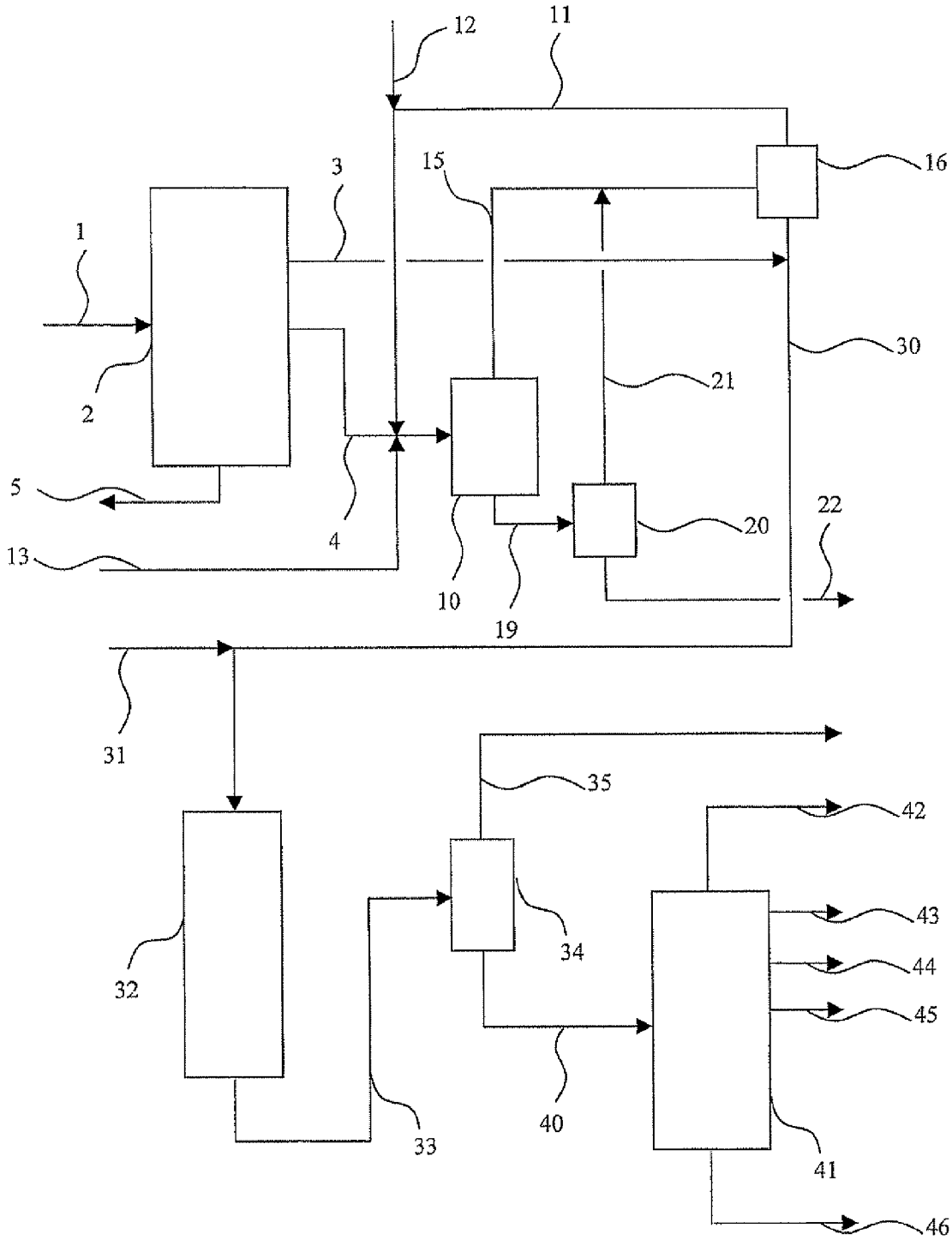

The heavy fraction which is drawn off from column 2 is sent, via conduit 4, to the means 10 for extraction of a liquid with a solvent. The solvent is sent to the extraction means via a conduit 11. Solvent may possibly be added via conduit 12. An external charge can be added via conduit 13 to the heavy fraction of the vacuum distillate. This external charge may be a vacuum distillate, for example, such as a straight-run vacuum distillate, a vacuum distillate resulting from a process for the conversion of heavy charges (coking, H-oil® or T-star® oil boiling bed, Hyvahl® fixed bed). This can also be an aromatic extract coming from an aromatic extraction unit.

The purified fraction and solvent coming from the extraction means 10 are drawn off via the conduit 15 and sent to a device for recovery and regeneration of the solvent 16. The solvent thus regenerated is sent to the extraction zone via the conduit 11.

The residuum comprising the extracted resins and the solvent is drawn off via conduit 19 and sent to a system for the recovery and regeneration of the solvent 20. The solvent which has thus been regenerated is sent to the extraction zone via a conduit 21 and the conduit 11. The residuum comprising the extracted resins and from which the solvent has been removed is drawn off via the conduit 22.

The purified fraction from which the solvent has been removed is drawn off via a conduit 30. The purified fraction is mixed with the light fraction of the vacuum distillate which has been brought by the conduit 3. The purified fraction and the light fraction of the vacuum distillate are sent, mixed together with the hydrogen which has been supplied by a conduit 31, to the hydrocracking means 32. The effluent which has resulted from the hydrocracking means is removed via the conduit 33 and sent to the means 34 for separating the gas and liquid. The gas is removed via a conduit 35.

The liquid coming from the separation means 34 is removed via a conduit 40 to an atmospheric distillation column 41. A gaseous fraction is drawn off from that column via a conduit 42, a petrol cut is drawn off via conduit 43, a kerosene cut is drawn off via a conduit 44, a gas oil cut is drawn off via a conduit 45, and a residuum cut is drawn off via conduit 46.

As mentioned hereinabove, the residuum can be 1) at least in part recycled to hydrocracking (apart from the waste),
2) at least in part sent to a fluidised bed catalytic cracking unit, or
3) at least in part sent to a dewaxing unit (preferably catalytic dewaxing), then to a hydrofinishing unit; partial recycling of the residuum to the hydrocracking stage also being able to be envisaged with options 2) or 3).

EXAMPLE 1

A vacuum distillate was distilled from an atmospheric residuum with a 40% by weight yield. This vacuum distillate has the following properties:

| Properties/Cuts | Vacuum Distillate |
|---|---|
| D15/4 | 0.9414 |
| Viscosity at 100° C., cSt | 13.8 |
| Nitrogen, ppm | 1357 |
| Sulphur, % by weight | 2.92 |
| Analysis by liquid chromatography, % by weight | |
| Saturated compounds, % by weight | 37.4 |
| Aromatics, % by weight | 52.7 |
| Resins, % by weight | 9.6 |
| Asphaltenes, % by weight | 0.0 |
| Loss, % by weight | 0.3 |
| Simulated distillation, | ° C. |
| Initial Point | 333 |
| 5% by weight | 399 |
| 10% by weight | 422 |
| 50% by weight | 494 |
| 90% by weight | 566 |
| 95% by weight | 582 |
| Final Point | 619 |

This vacuum distillate is introduced into a pilot comprising two reactors in series. The first reactor R1 is filled with the catalyst known under the reference HR448 of the company AXENS, which catalyst is a catalyst for pre-treatment of the vacuum distillate of NiMo type on alumina, the objective of which is denitrogenation to very low contents of the vacuum distillate. The second reactor R2 is filled with catalyst known under the reference HYC642 of the company AXENS, which catalyst is a zeolitic catalyst for hydrocracking (zeolite Y on alumina) which permits conversion of the order of 70% by weight of the 370° C.+ fraction of the vacuum distillate.

The operating conditions and yields are given in the following table:

| | |
|---|---|
| Conditions R1/HR448: | |
| LHSV, h-1 | 0.75 |
| Partial pressure of H2, bar | 135 |
| Nitrogen content output R1, ppm | 6 |
| Conditions R2/HYC642: | |
| LHSV, h-1 | 1.5 |
| Partial pressure of H2, bar | 125 |
| Ratio H2/charge, st 1/1 | 1000 |
| Petrol: | |
| Yield in relation to the charge, % by weight | 18.4 |
| RON | 65 |
| Kerosene: | |
| Yield in relation to the charge, % by weight | 25.1 |
| Smoke point | 25 |
| Diesel: | |
| Yield in relation to the charge, % by weight | 22.0 |
| Engine cetane | 61 |
| Residuum: | |
| Yield in relation to the charge, % by weight | 31.5 |
| D15/4 | 0.845 |
| Consumption of hydrogen, % by weight | 2.25 |

EXAMPLE 2

According to the Invention

The vacuum distillate of Example 1 is distilled in vacuo in order to obtain a light fraction and a heavy fraction corresponding to a cut point of 500° C. The yields and properties of the vacuum distillate and of the two fractions are as follows:

| Properties/Cuts | Vacuum Distillate | Light fraction | Heavy fraction |
|---|---|---|---|
| Yield by weight, % by weight | 100 | 50.4 | 49.6 |
| D15/4 | 0.9414 | 0.9312 | 0.9519 |
| Viscosity at 100° C., cSt | 13.8 | | 27.3 |
| Nitrogen, ppm | 1357 | 950 | 1747 |
| Sulphur, % by weight | 2.92 | 2.85 | 2.99 |
| Analysis by liquid chromatography, % by weight | | | |
| Saturated compounds, % by weight | 37.4 | 42.9 | 31.8 |
| Aromatics, % by weight | 52.7 | 50.3 | 55.2 |
| Resins, % by weight | 9.6 | 6.1 | 12.9 |

-continued

| Properties/Cuts | Vacuum Distillate | Light fraction | Heavy fraction |
|---|---|---|---|
| Asphaltenes, % by weight | 0.0 | 0.0 | 0.0 |
| Loss, % by weight | 0..3 | 0.7 | 0.1 |
| Simulated distillation, ° C. | | | |
| Initial Point | 333 | | 444 |
| 5% by weight | 399 | | 480 |
| 10% by weight | 422 | | 493 |
| 50% by weight | 494 | | 539 |
| 90% by weight | 566 | | 587 |
| 95% by weight | 582 | | 601 |
| Final Point | 619 | | 658 |

The heavy fraction is deresined by liquid-liquid extraction using a paraffinic, non polar solvent, i.e. propane. The technology used is that currently used for the deasphalting of vacuum residua.

40 kg of the heavy fraction was mixed with propane in a reactor which is agitated and which has a volume ratio of solvent/heavy fraction of 8/1. The mixture is brought to 90° C., and is agitated for 60 minutes. After that time, agitation is stopped, and the mixture decants for 90 minutes so as to bring about the separation of two phases. The phase depleted in resins at the top of the output and the phase rich in resins at the bottom of the output are drawn off separately and treated so as to evaporate the propane.

The phase depleted of resins and the phase rich in resins following evaporation of the propane have the following properties, in comparison with that of the heavy fraction:

| Properties/Cuts | Heavy fraction of the vacuum distillate | Purified fraction of resins | Fraction enriched with resins |
|---|---|---|---|
| Yield by weight, % by weight | 100 | 84.6 | 15.4 |
| D15/4 | 0.9519 | 0.9470 | 0.9788 |
| Viscosity at 100° C., cSt | 27.3 | | |
| Nitrogen, ppm | 1747 | 1000 | 5800 |
| Sulphur, % by weight | 2.99 | 2.85 | 3.75 |
| Analysis by liquid chromatography, % by weight | | | |
| Saturated compounds, % by weight | 31.8 | 37.3 | 1.5 |
| Aromatics, % by weight | 55.2 | 55.0 | 57.4 |
| Resins, % by weight | 12.9 | 7.7 | 41.0 |
| Asphaltenes, % by weight | 0.0 | 0.0 | 0.0 |
| Loss, % by weight | 0.1 | 0.8 | 0.1 |
| Simulated distillation, ° C. | | | |
| Initial Point | 44 | 433 | 427 |
| 5% by weight | 480 | 471 | 489 |
| 10% by weight | 493 | 485 | 503 |
| 50% by weight | 539 | 530 | 552 |
| 90% by weight | 587 | 582 | 604 |
| 95% by weight | 601 | 596 | 616 |
| Final Point | 658 | 645 | 665 |

From the heavy fraction of the vacuum distillate, 40% by weight is extracted of the resins contained in that fraction.

The purified fraction of the resins is then mixed with the light fraction of the vacuum distillate in order to reconstitute a large vacuum distillate which will be hydrocracked.

The mixture thus reconstituted has the following properties in comparison with the vacuum distillate of Example 1:

| Properties/Cuts | Vacuum Distillate of Example 1 | Mixture of the light fraction of the vacuum distillate and of the purified heavy fraction |
|---|---|---|
| Yield by weight, % by weight. | 100 | 92.4 |
| D15/4 | 0.9414 | 0.9384 |
| Viscosity at 100° C., cSt | 13.8 | |
| Nitrogen, ppm | 1357 | 970 |
| Analysis by liquid chromatography, % by weight | | |
| Saturated compounds, % by weight | 37.4 | 40.3 |
| Aromatics, % by weight | 52.7 | 52.4 |
| Resins, % by weight | 9.6 | 6.8 |
| Asphaltenes, % by weight | 0.0 | 0.0 |
| Loss, % by weight | 0.3 | 0..5 |
| Simulated distillation, ° C. | | |
| Initial Point | 333 | |
| 5% by weight | 399 | |
| 10% by weight | 422 | |
| 50% by weight | 494 | |
| 90% by weight | 566 | |
| 95% by weight | 582 | |
| Final Point | 619 | |

The contents of resins and of nitrogen of the mixture are reduced by about 30% in comparison with the vacuum distillate of Example 1. This partial purification of the charge can appear low, but is nonetheless advantageous in that it requires less extraction equipment and has a significant impact upon the hydrocracking operating conditions.

The mixture which is thus reconstituted is introduced into the same pilot as in Example 1, with the same catalytic system. To carry out the same global conversion of the order of 70% by weight of the 370° C.+ fraction of the mixture as in Example 1 it is necessary to set up the following operating conditions:

| | |
|---|---|
| HR448 Conditions: | |
| LHSV, h-1 | 0.75 |
| Partial pressure of H2, bar | 105 |
| Content of nitrogen at exit from reactor 1,ppm | 7 |
| HYC642 Conditions: | |
| LHSV, h-1 | 1.5 |
| Partial pressure of H2, bar | 95 |
| H2/charge ratio, st 1/1 | 780 |
| Petroleum: | |
| Yield in relation to the charge, % by weight | 19.0 |
| RON | 67 |
| Kerosene: | |
| Yield in relation to the charge, % by weight | 24.5 |
| Smoke point | 24 |

-continued

| | |
|---|---|
| Diesel: | |
| Yield in relation to the charge, % by weight | 22.3 |
| Cetane engine | 60 |
| Residuum: | |
| Yield in relation to the charge, % by weight | 30.8 |
| D15/4 | 0.848 |
| Consumption of Hydrogen, % by weight | 1.95 |

The operating conditions of Example 2 are characterised in relation to Example 1 by a partial pressure of hydrogen of less than 30 bars, with everything else remaining the same. The structure of the yield is identical with Example 1, and likewise the quality of the products, but the associated hydrogen consumption is reduced by 13%.

The invention claimed is:

1. A process for the treatment of a hydrocarbon charge containing resin, at least 80% of the compounds of the charge having a boiling point which is above or equal to 340° C., said process comprising:

a) fractionating the charge to recover:

at least one heavy fraction comprising at least 90% by weight of compounds which boil at above 450° C. and at below 700° C., and at least one light fraction which boils at less than the heavy fraction(s), a residuum which boils at more than the heavy fraction(s), b) extracting at least part of the heavy fraction with a paraffinic solvent having 3 to 7 carbon atoms, to remove at least some of the resins contained in said heavy fraction and to recover a resin depleted fraction, c) in a stage separate from the extracting stage (5) and after removal of said paraffinic solvents from said resin-depleted heavy fraction, mixing directly at least part of the resin-depleted heavy fraction with at least one light fraction obtained in the fractionation stage, and d) passing the resultant mixture to a cracking stage.

2. A process according to claim 1, in which the content of resins in the 340° C.-700° C. fraction of the charge is between 3 and 15% by weight.

3. A process according to claim 1, in which the heavy fraction resulting from the first fractionation stage comprises a resin content of more than 5% by weight.

4. A process according to claim 1, in which at least 20% by weight of the resins contained in the heavy fraction is extracted.

5. A process according to claim 1, in which the extraction of the resins of the heavy fraction makes it possible to obtain a purified fraction with a content of polyaromatic compounds comprising up to 5 cycles of less than 2% by weight.

6. A process according to claim 1, in which the extraction of the resins of the heavy fraction makes it possible to obtain a purified fraction, the nitrogen content of which is reduced by at least 20% by weight in relation to the heavy fraction which was introduced in the extraction stage.

7. A process according to claim 1, in which the extraction stage is carried out in an extraction column, using propane, under the following operating conditions:

a solvent ratio of between 2/1 and 12/1, a temperature at the head of the extractor of between 55 and 95° C., a temperature at the bottom of the extractor of between 30 and 80° C., a pressure in the extractor of between 300 and 400 MPa, and between 2 and 5 theoretical stages.

8. A process according to claim 1, in which the cracking stage is hydrocracking.

9. A process according to claim 8, in which a residuum fraction is obtained from the hydrocracking stage and is sent, at least in part, to a dewaxing and hydrofinishing section for making oil bases.

10. A process according to claim 1, in which a residuum fraction is obtained from the hydrocracking stage and is sent, at least in pail, to an FCC unit.

11. A process according to claim 8, in which a residuum fraction is obtained from the hydrocracking stage, and is recycled, at least in part, to the hydrocracking stage.

12. A process according to claim 1, in which the cracking stage is catalytic cracking in fluidised bed (FCC).

13. A process according to claim 12, in which the FCC stage is preceded by a hydrotreatment stage.

14. A process according to claim 1, in which the charge is selected from a direct distillation residuum, a residuum from a conversion process, a coking residuum, a residuum from a hydroconversion process in fixed bed, a residuum from a conversion process in boiling bed, or a mixture of any one of these.

15. A process according to claim 1, in which an external charge is added to the heavy fraction entering the extraction stage, said charge being a vacuum distillate or an aromatic extract.

16. A process according to claim 1, wherein the parafinic solvent has 3 to 5 carbon atoms.

17. A process according to claim 1, wherein the paraffinic solvent is a heptane.

18. A process for the treatment of a hydrocarbon charge containing resin, at least 80% of the compounds of the change having a boiling point which is above or equal to 340° C., said process comprising:

a) fractionating the charge to recover at least one heavy fraction comprising at least 90% by weight of compounds which boil at above 450° C. and at below 700° C., and at least one light fraction which boils at less than the heavy fraction(s), a residuum which boils at more than the heavy fraction(s), b) extracting at least part of the heavy fraction with a paraffinic solvent having 3 to 7 carbon atoms, to remove at least some of the resins contained in said heavy fraction and to recover a resin-depleted fraction, c) mixing directly at least part of the resin-depleted heavy fraction with at least part of the purified fraction obtained in the extraction stage and at least one light fraction obtained in the fractionation stage, and d) passing the resultant mixture to a cracking stage.

* * * * *

UNITED STATES PATENT AND TRADEMARK OFFICE

CERTIFICATE OF CORRECTION

PATENT NO. : 7,582,204 B2
APPLICATION NO. : 10/584048
DATED : September 1, 2009
INVENTOR(S) : Gueret et al.

It is certified that error appears in the above-identified patent and that said Letters Patent is hereby corrected as shown below:

Column 13, line 12, claim 10 reads "at least in pail, to an FCC unit.", should read -- at least in part, to an FCC unit. --

Signed and Sealed this

Twentieth Day of October, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,582,204 B2
APPLICATION NO. : 10/584048
DATED : September 1, 2009
INVENTOR(S) : Gueret et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 425 days.

Signed and Sealed this

Fourteenth Day of September, 2010

David J. Kappos

David J. Kappos
*Director of the United States Patent and Trademark Office*